United States Patent [19]

Hagedorn

[11] 4,055,256

[45] Oct. 25, 1977

[54] PACKAGE STACKING METHOD AND APPARATUS

[76] Inventor: Hans Hagedorn, 947 Huntington Crescent, North Vancouver, British Columbia, Canada, V7G 1M4

[21] Appl. No.: 622,386

[22] Filed: Oct. 14, 1975

[51] Int. Cl.[2] ..... B65G 57/06

[52] U.S. Cl. ..... 214/6 DK; 214/6 H; 214/6 S

[58] Field of Search ..... 214/6 DK, 6 H, 6 P, 214/6 S; 53/162, 164; 271/182, 211, 224, 229, 230; 193/35 A

[56] References Cited

U.S. PATENT DOCUMENTS

| | | | |
|---|---|---|---|
| 1,831,130 | 11/1931 | Mudd | 214/6 DK X |
| 2,956,381 | 10/1960 | Chauvin et al. | 214/6 H X |
| 2,969,629 | 1/1961 | Blais | 53/164 X |
| 3,041,803 | 7/1962 | Gamberini | 53/162 X |
| 3,346,128 | 10/1967 | Hullhorst | 214/6 DK |
| 3,382,966 | 5/1968 | Califano et al. | 214/6 S X |
| 3,566,576 | 3/1971 | Ayres et al. | 214/6 P |
| 3,624,782 | 11/1971 | McPeek et al. | 214/6 P |

*Primary Examiner*—L. J. Paperner

*Attorney, Agent, or Firm*—Fetherstonhaugh & Company

[57] ABSTRACT

Method and apparatus whereby a predetermined number of packages are moved over a cushion of air into a horizontal row, following which the row is deposited on an elevator which is then depressed a distance equal to the thickness of the packages. This is repeated until a desired number of rows of packages are deposited on the elevator thereby forming the packages into stacks, following which the stacks are moved laterally off the elevator on to a conveyor. The elevator is moved successively to shift the stacks into a position where they can be fed into a carton packaging machine.

22 Claims, 19 Drawing Figures

10
40
46
41
27
15
42
56
34
78
29
70
235
250
265
255
13
32
182
266
173
166
180
7
232
226
224
125
80
142
176
235
119
84
246
83
175
231
85
25
230

40
49
46
41
27
42
50a
25
59
15
56
52
55
34
29
53
54
65
35
37
28
38
36
32
18
80
82
83

PACKAGE STACKING METHOD AND APPARATUS

This invention relates to a package stacking method and apparatus by means of which packages are automatically arranged in a plurality of stacks so that the stacks can be successively fed into a wrapping or carton applying machine.

In the past packages have been stacked by hand so as to be fed into bundling machines (wrapping or carton applying machines) because of the difficulty of getting the packages into uniform stacks by machine, and the necessity of being able to handle packages of different sizes and of arranging them into stacks of different numbers. Apparatus of this nature is usually needed by companies who are packaging numerous different commodities with the result that the packages of these different commodities are of various sizes. Furthermore, when the packages are to be placed in stacks in the bundling machine, the number of packages in each carton or bundle depends upon the size of the packages. To be useful in these industries, the package stacking apparatus must be quickly and easily adjustable to handle packages of different sizes, and to arrange them into stacks containing different numbers of these packages. These difficulties have been so great that most of the stacking is done by hand.

The present apparatus has successfully overcome these problems. This has been accomplished by moving the packages in successive rows over a cushion of air which prevents the packages from turning relative to each other and from climbing on top of each other. When a predetermined number of packages are arranged in a row, the row is deposited on an elevator which then is indexed downwardly the distance equal to the depth of a package. The packages are thus built up in stacks on the elevator. The apparatus can be easily adjusted to take a single row of packages each time, or two or three rows at a time. In addition, the apparatus is easily adjusted to form different numbers of packages in each stack. After a predetermined number of packages have been deposited in stacks on the elevator the packages are pressed together so that they are properly aligned in their respective stacks. After this, the row of stacks is shifted laterally off the elevator and on to a conveyor. This conveyor operates to shift the stacks in succession into position to be moved into a bundling machine.

Both the method and apparatus for stacking the packages are novel.

The method according to the present invention comprises sequentially forming horizontal rows of a predetermined number of similar packages while guiding said packages to prevent lateral displacement thereof, successively depositing the package rows on to an elevator, depressing the elevator by substantially the thickness of a package after each row is deposited thereon, thereby forming stacks of predetermined numbers of packages on the elevator, and shifting said stacks off the elevator.

The apparatus for carrying out this method comprises a horizontal support, means for directing packages one by one on to said support to form a plurality of successive rows of a predetermined number of packages, means for shifting said support after each row is formed thereon to deposit said row on to a depressible elevator positioned therebeneath, means for depressing the elevator by substantially a package thickness after each row is deposited thereon, thereby forming stacks of predetermined numbers of packages on the elevator, and means for shifting said stacks off the elevator.

An example of the present apparatus is illustrated in the accompanying drawings, in which.

Figure 1:
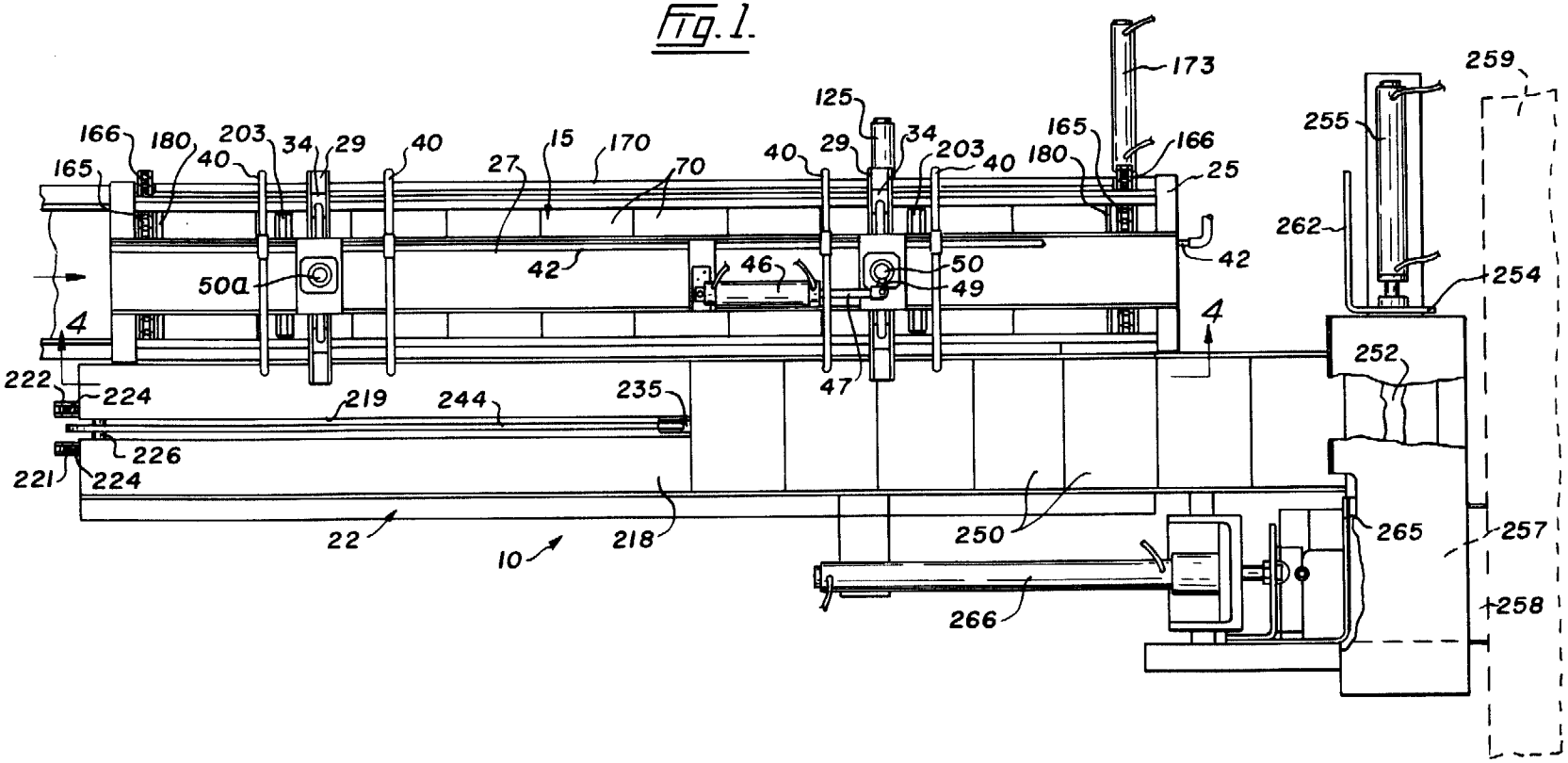
FIG. 1 is a plan view of the apparatus.
Figure 3:
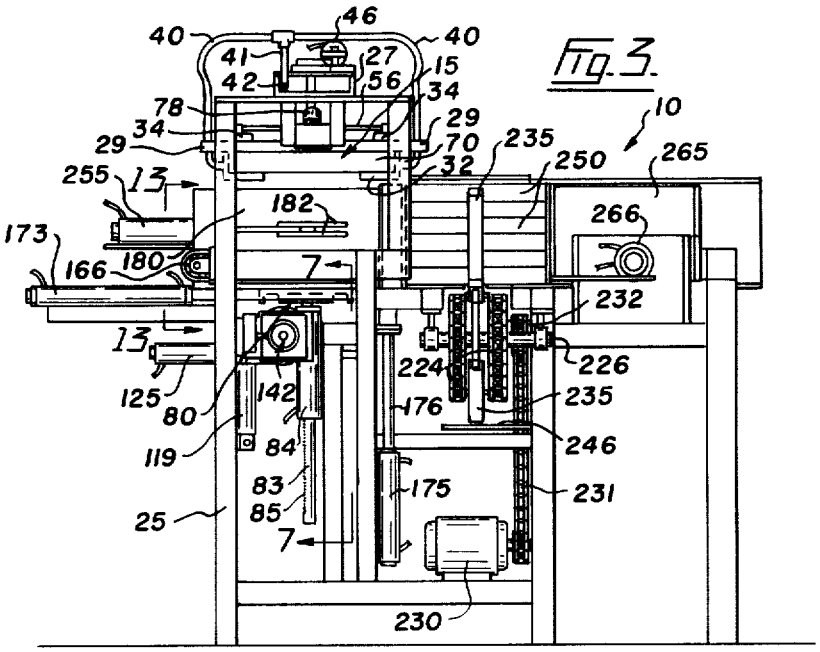
FIG. 3 is an end elevation.
Figure 6:
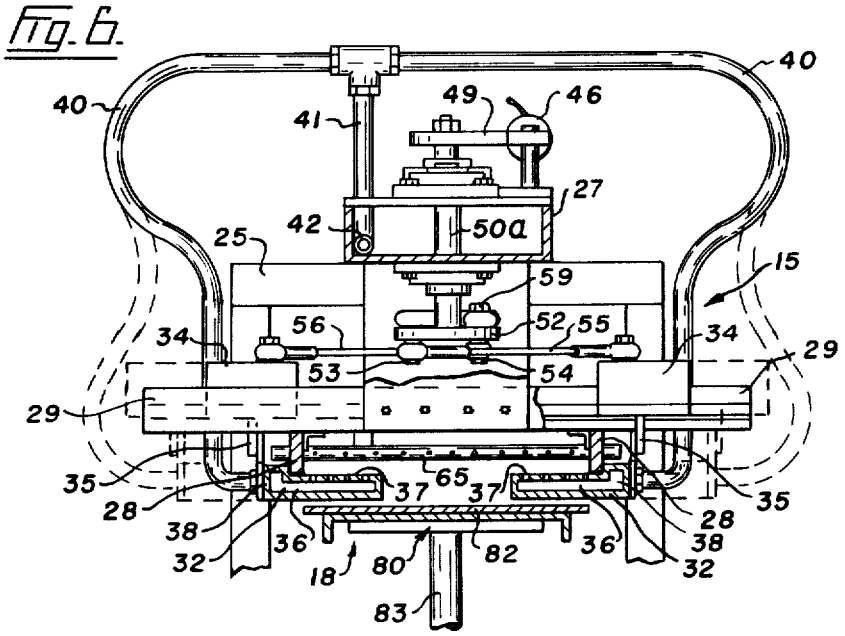
Figure 4:
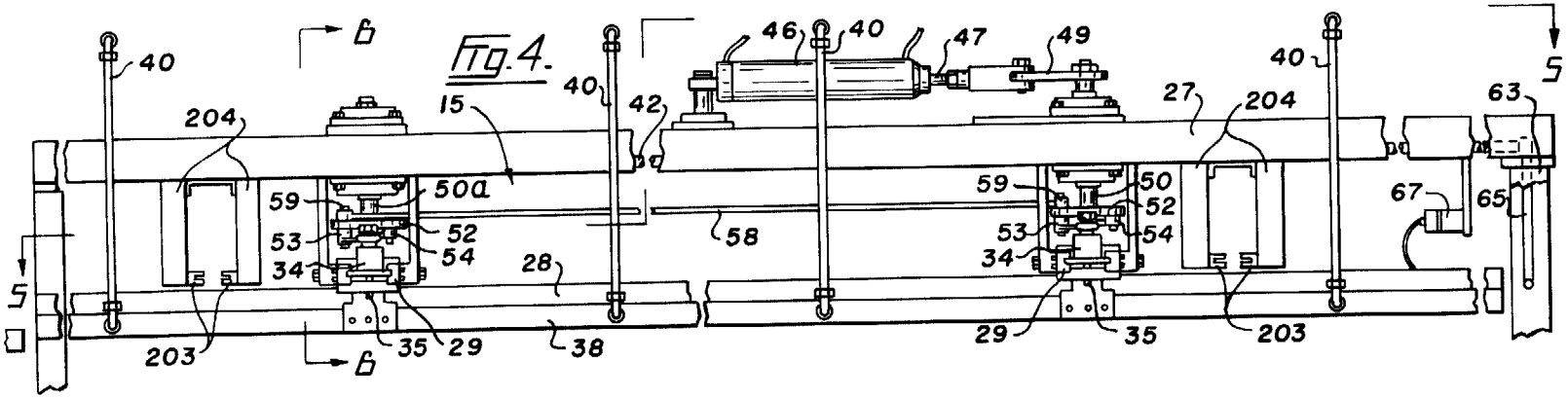
Figure 5:
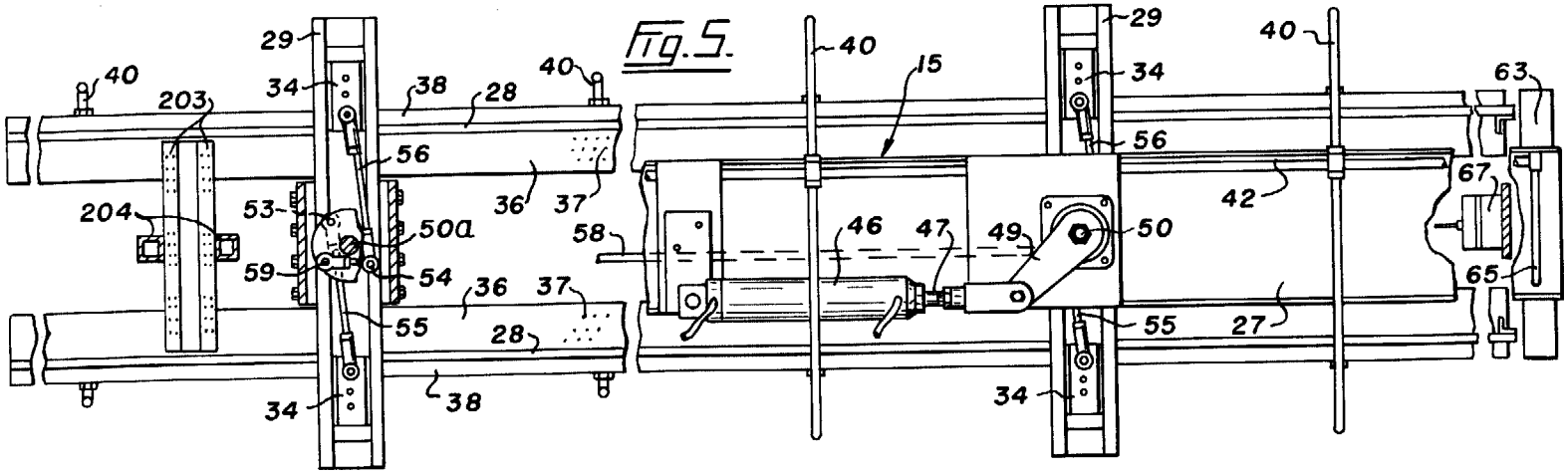
Figure 7:
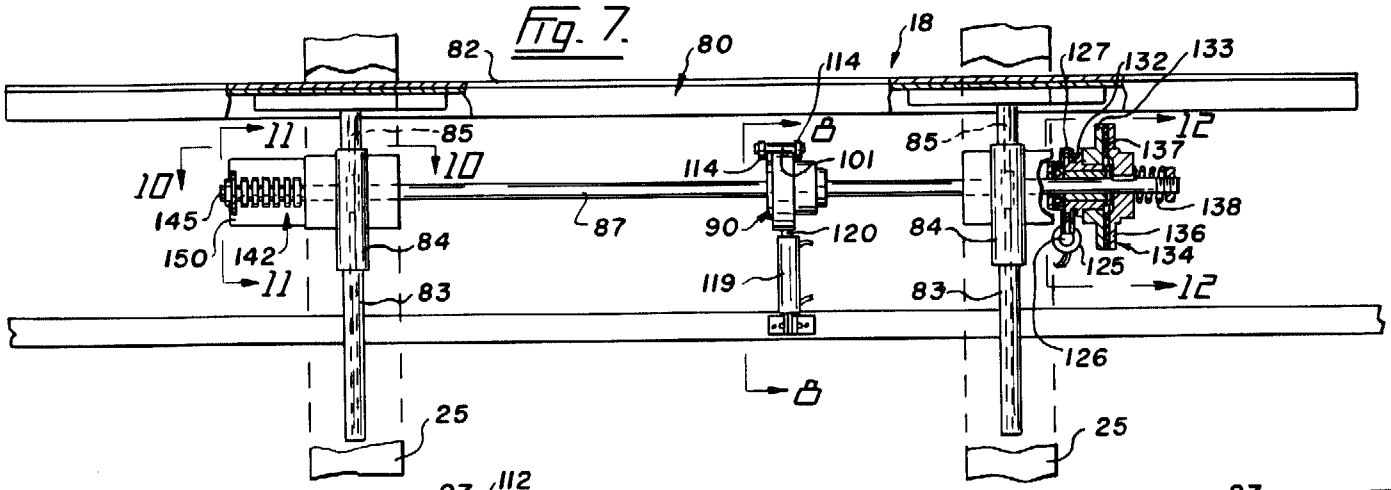
Figure 9:
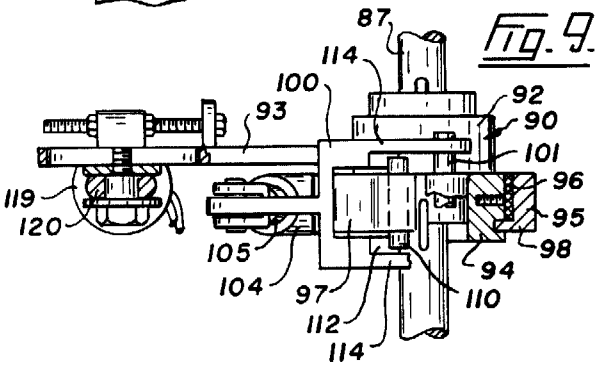
Figure 8:
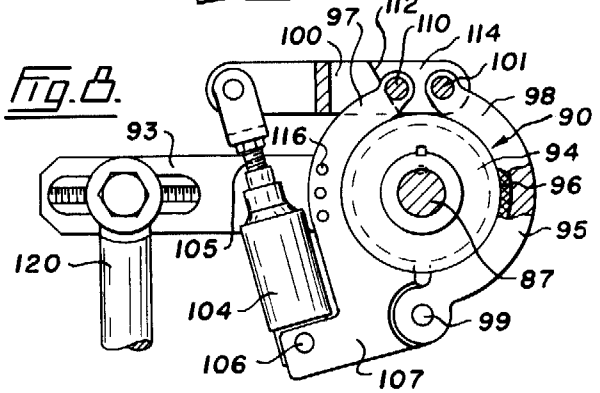
Figure 10:
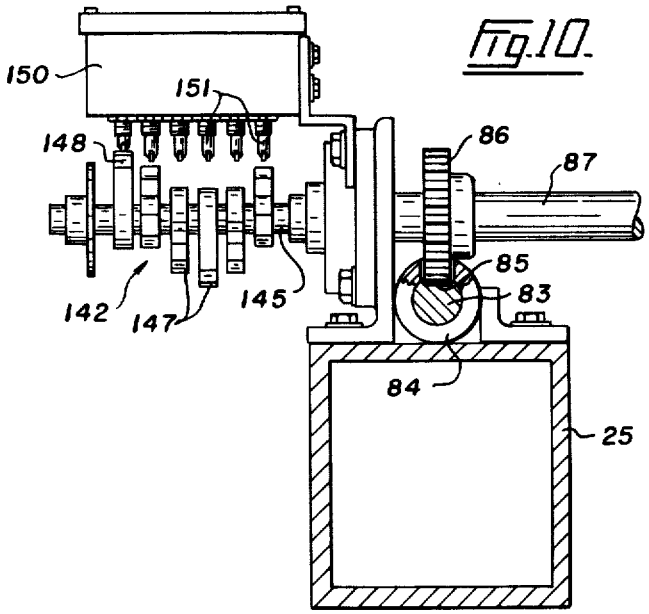
Figure 11:
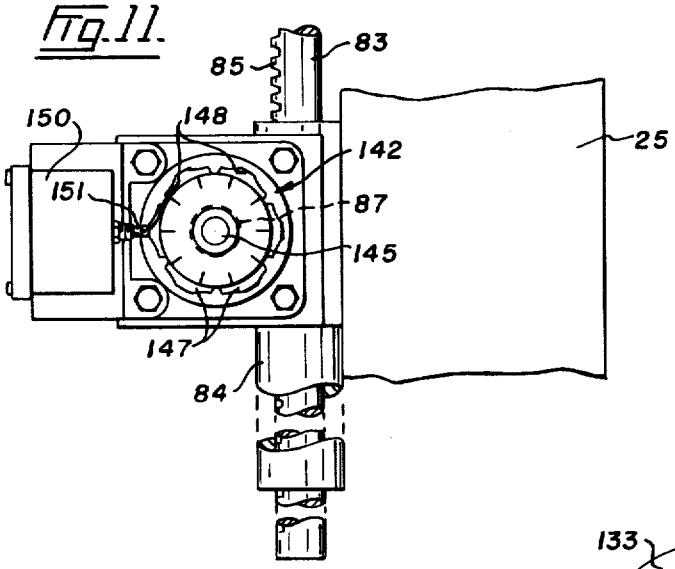
Figure 12:
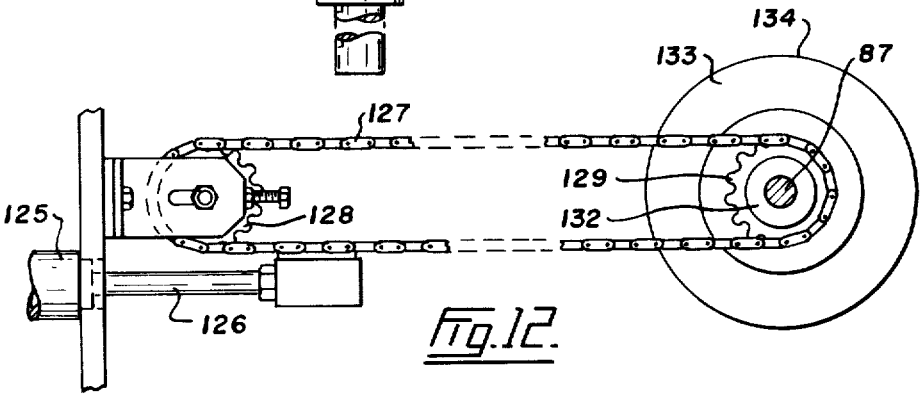
Figure 13:
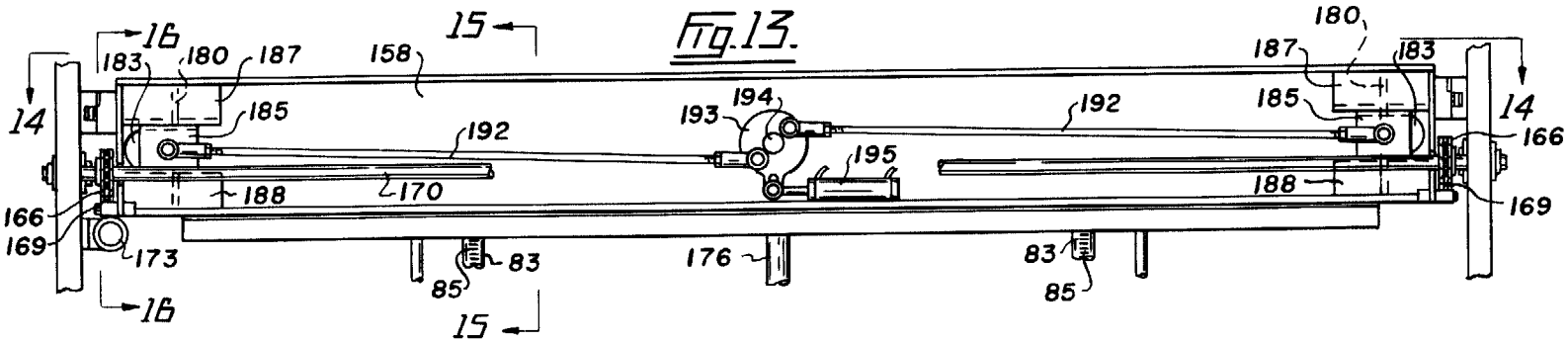
Figure 14:
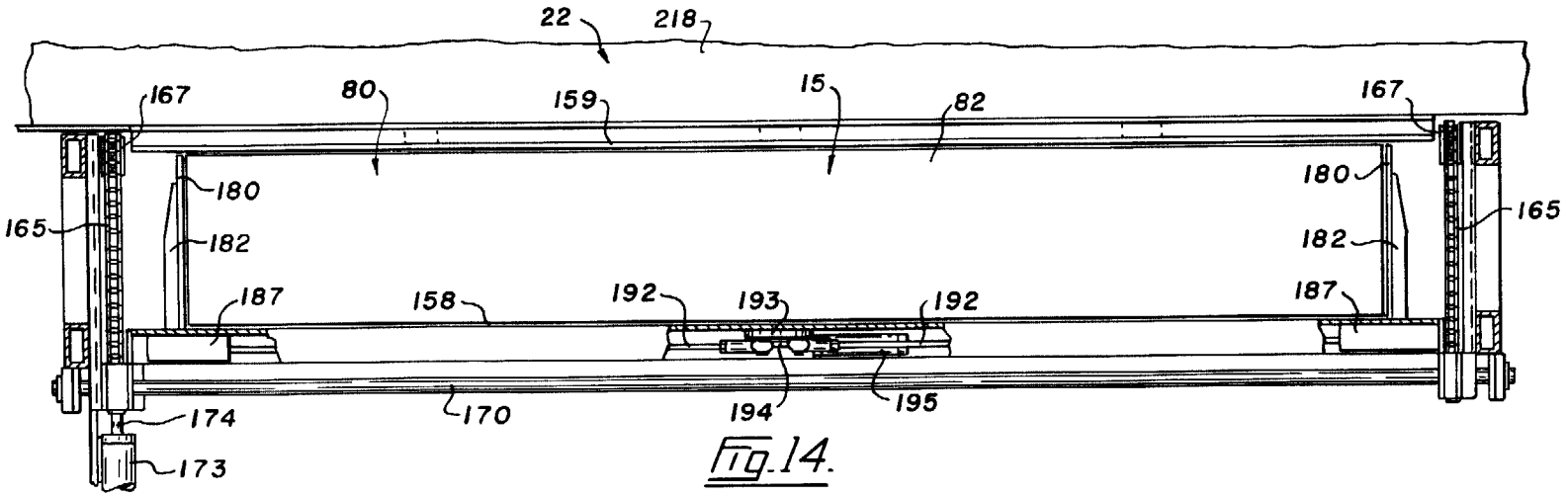
Figure 15:
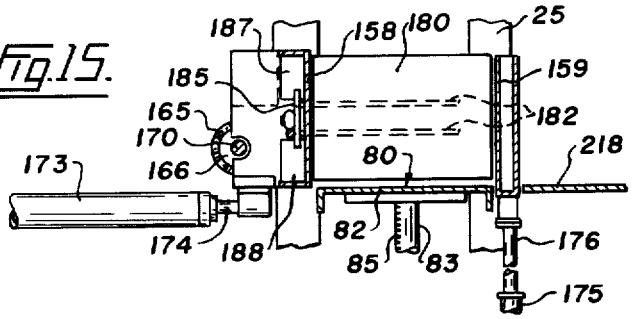
Figure 16:
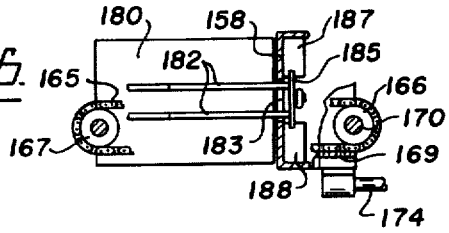
Figure 17:
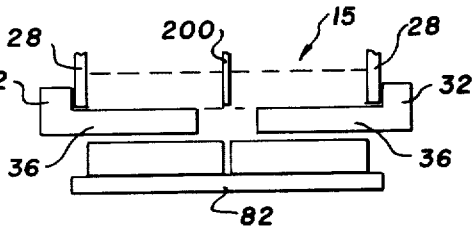
Figure 18:
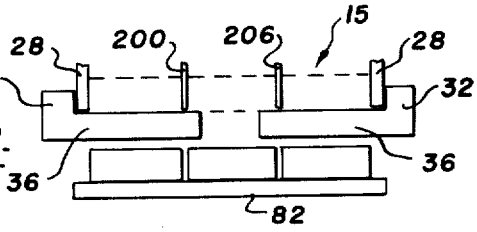
Figure 19:
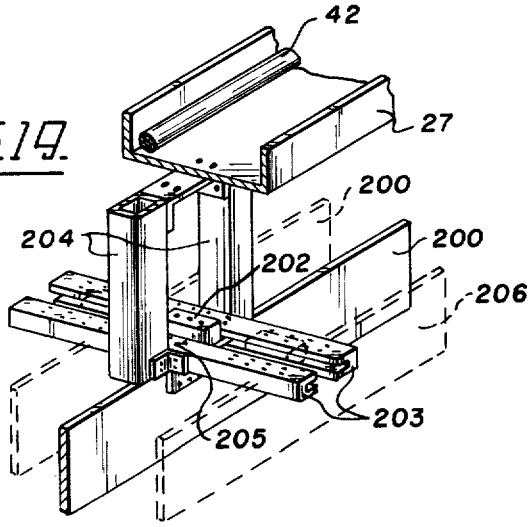

FIG. 4 is an enlarged side elevation of the row forming section of the apparatus as seen from 4—4 of FIG. 1, FIG. 5 is a horizontal section taken on the line 5—5 of FIG. 4, FIG. 6 is an enlarged cross section taken on line 6—6 of FIG. 4, FIG. 7 is a fragmentary vertical section taken on the line 7—7 of FIG. 3, FIG. 8 is an enlarged section taken on the line 8—8 of FIG. 7, showing a ratchet in elevation for lowering the elevator and the apparatus, FIG. 9 is a plan view of the ratchet of FIG. 8, FIG. 10 is an enlarged section taken on the line 10—10 of FIG. 7, showing the indexing control for the elevator, FIG. 11 is an enlarged section on the line 11—11 of FIG. 7, showing the indexing control in elevation, FIG. 12 is an enlarged section on the line 12—12 of FIG. 7, showing in elevation the mechanism for raising the elevator, FIG. 13 is an enlarged vertical section on the line 13—13 of FIG. 3, FIG. 14 is a plan view of the apparatus as seen from line 14—14 of FIG. 13, FIG. 15 is a cross section on line 15—15 of FIG. 13, FIG. 16 is a fragmentary section on the line 16—16 of FIG. 13, FIG. 17 is a sectional view illustrating an alternative arrangement for supporting the packages above the elevator, FIG. 18 is a view similar to FIG. 17 illustrating another alternative arrangement for supporting the packages above the elevator, and FIG. 19 is an enlarged perspective view of the arrangement of FIG. 17.

Referring to FIGS. 1 to 6 of the drawings, 10 is a package stacking apparatus in accordance with this invention. This apparatus includes a stack forming section 15, an elevator section 18 below the stack section, and a conveyor section 22 positioned beside the elevator section.

These sections are within and supported by a suitable framework 25. This framework includes an upper horizontal beam 27, a pair of laterally spaced side members 28 and longitudinally spaced cross members 29.

A pair of hollow support members or plates 32 are mounted in stack section 15, extending longitudinally thereof, and are movable towards and away from each other. These support members or plates are substantially L-shaped in cross section, see FIG. 6, and are suspended below blocks 34 by vertical connectors 35, said blocks being slidably mounted on cross members 29. Each support member 32 has a horizontal support 36 having a perforated upper surface 37 and a vertical portion 38. When members 32 are in their inner positions, as shown in FIG. 6, the inner edges of supports 36 are near each other so that they form a supporting surface extending across stack section 15. Air is directed into support members 32 by a plurality of flexible tubes 40, said tubes being arranged in pairs spaced longitudinally of the stack section, each pair of tubes communicating with the vertical pipe 41 which, in turn, is connected to a header pipe 42 mounted in beam 27 and extending to a source of air under pressure, not shown.

Suitable means is provided for simultaneously moving supports 36 away from each other, and in this example, the movement of the supports is created by a fluid cylinder 46 having a piston rod 47 projecting from an end thereof, said rod being connected to a crank arm 49 which, in turn, is connected to a vertical shaft 50. This shaft has a crank disk 52 mounted thereon beneath beam 27, said disk having pins 53 and 54 thereon diametrically on opposite sides of shaft 50, said pins being connected by links 55 and 56 to blocks 34 at opposite sides of the machine. By referring to FIGS. 4 and 5, it will be seen that there is a shaft 50a which is a duplicate of shaft 50 spaced from the latter longitudinally of the section 15, said shaft 50a having the same disk and link arrangement associated therewith for moving the adjacent blocks 34. A relatively long link 58 interconnects pins 59 on the two disks 52 so that the two discs move in unison under the action of cylinder 46.

Suitable stop means is provided at the outer end 63 of stack section 15. In this example, a perforated pipe 65 is positioned a little above the level of supports 36 at said section end, this pipe being connected to header pipe 42 so that air is directed horizontally over the upper surfaces of supports 36 at the outer ends thereof. A limit switch 67 is supported immediately above the supports 36 near their outer ends.

When apparatus 10 is in operation, packages 70 are fed into stack section 15 at its outer end 72 in succession by a suitable conveyor, not shown. Each package is moved by the following package on to supports 36 of the supporting members 32 and are maintained a little above said supports by the air blowing out through the perforations of their upper surfaces 37. The vertical portions 38 of support members 32 act as side walls for a passage, the bottom of which is formed by supports 36. These side walls and the air keep the packages in proper alignment as they move along the stacking section 15. The air from pipe 65 stops the row of packages as the row reaches said pipe. At the same time, limit switch 67 is operated by the first package of the row to stop the feeding of the packages.

Limit switch 67 may cause the infeed conveyor to stop moving and thereby stop feeding the packages to apparatus 10, or as illustrated in the present apparatus, suitable means may be provided for stopping the movement of the packages within stack section 15, in which case the infeed conveyor may be one that can keep moving even though the packages thereon are stopped. For this purpose a pressure plate 75 is normally positioned above supports 36 at the infeed end thereof, see FIG. 2. This plate is carried by piston rod 77 of a fluid cylinder 78 which is carried by bracket 79 extending down from beam 27. This cylinder is connected to a fluid system which is controlled by switch 67 so that when the latter is operated by a package therebeneath, cylinder 78 is energized to move plate 75 down on to the package therebeneath to clamp it against the supports 36, thereby stopping movement of the packages in stack section 15 and locking the packages therein.

An elevator 80 is positioned in elevator section 18 immediately beneath the supports 36. This elevator has a platform 82 which is supported and moved in any desired manner. When apparatus 10 first starts to operate, platform 82 is positioned immediately beneath supports 36, as shown in FIG. 6. When supports 36 are separated, the row of packages thereon drops down onto the elevator platform, and as this is very close to the supports, the packages cannot tip or get out of position at this time. Then the elevator is indexed downwardly a distance equal to the thickness of a package so that it is ready to receive the next row of packages. This action is continued until the desired number of packages are placed in stacks on the elevator. After these packages are shifted off the elevator, platform 82 is moved up to its initial position immediately beneath supports 36.

In this example, elevator platform 82 is carried by two vertical shafts or racks 83, one near each end of the platform. These shafts extend through sleeves 84 which are mounted on the framework 25. These shafts or racks have teeth 85 meshing with gears 86 fixedly mounted on a horizontal indexing shaft 87 which is journalled in suitable bearings carried by the framework.

Elevator platform 82 is indexed downwardly step by step by a ratchet 90 mounted on shaft 87, see FIGS. 7, 8, and 9. The ratchet 90 includes an over-riding clutch 92 which is fixedly connected to shaft 87 and is operated by a lever 93. Shaft 87 is rotated when lever 93 is moved in one direction, and remains stationary when the lever is moved in the opposite direction. The operation of lever 93 intermittently rotates shaft 87 to depress platform 82. As it is necessary to rotate the shaft in the opposite direction in order to return the platform to its upper position, the shaft must be freed from the action of clutch 92 at this time. For this purpose, the clutch is operated by a drum 94 which, in turn, is rotated by a split ring 95 which surrounds the drum, there being a brake band 96 therebetween. Ring 95 is formed in two sections 97 and 98 hingedly connected together by a pin 99. An arm 100 is swingably mounted on ring section 98 by a pin 101 and projects away therefrom, see FIG. 8. A fluid cylinder 104 has a ram 105 projecting therefrom connected to the outer end of arm 100, said cylinder being mounted by a pin 106 on a projection 107 which in turn is fixedly connected to ring section 97. Band 96 is connected at one end to pin 101, extends around the outer surface of drum 94 and has cam followers 110 connected to its opposite end, said followers being positioned against inclined surfaces 112 formed on arm 100. By referring to FIG. 9, it will be seen that arm 100 is in the form of a yolk at its inner end having space-apart guide members 114. This yolk spans ring 95, and the cam surfaces 112 are formed on the guide members 114.

With this arrangement, when cylinder 104 is energized its rod 105 is extended to swing arm 100 around its pivot pin 101, thereby tightening brake band 96 on to drum 94 so that the drum moves with ring 95. This ring is connected by a pin 116 to lever 93, see FIG. 8.

A fluid cylinder 119 has a piston rod 120 projecting therefrom, the outer end of which is connected to lever 93. When cylinder 119 is energized to extend rod 120, lever 93 is moved to cause clutch 92 to rotate shaft 87, and when the piston rod is retracted, the lever is moved in the opposite direction, while the shaft remains stationary. This action takes place as long as cylinder 104 of the ratchet is energized. On the other hand, when the latter cylinder is de-energized, shaft 87 can be rotated in the opposite direction. This operation of ratchet 90 intermittently moves elevator platform 82 downwardly.

Elevator platform 82 is returned to its upper position by a fluid cylinder 125 having a piston rod 126 extending outwardly therefrom, said rod being connected to a chain 127 trained on sprockets 128 and 129, see FIGS. 7 and 12. Sprocket 129 is fixedly mounted on a sleeve 132 through which shaft 87 freely extends, this sleeve being connected to disk 133 of a clutch 134. Another disk 136 which is keyed to shaft 87 has a lining 137 on its inner face, and is resiliently urged by spring 138 against disk 133. There is enough slippage in clutch 134 to allow the shaft to rotate under the action of ratchet 90 to lower platform 82, but when cylinder 125 is energized, the shaft is rotated in the opposite direction through chain drive 127, at which time cylinder 104 of the ratchet is de-energized to release the brake lining 96 to allow this rotation to take place.

FIGS. 10 and 11 illustrate an indexing control 142 for shaft 87. This control consists of a shaft 145 coupled to the end of shaft 87 and having a plurality of cams 147 adjustably mounted thereon. Each of these cams has a nob 148 projecting from its edge, and these cams are circumferentially spaced from each other around shaft 145, see FIG. 11. A switch box 150 has a plurality of cam followers 151 projecting therefrom, one in line with each cam 147 and positioned to be depressed by the nob 148 of its cam when engaged thereby. Each cam follower, when depressed, operates a switch, not shown, in box 150. These switches form part of the electrical circuitry, by means of which ratchet cylinder 119 is energized. In this example, there are six cams and switches for indexing the elevator after receiving each of six packages. When the elevator is moved downwardly a distance equal to the thickness of a package as a result of the closing of a limit switch (not shown) by the outward movement of supporting members 32, a cam engages its switch to stop the elevator. This action is repeated until there are six packages in each stack in the elevator.

After the elevator has reached its lowermost position, and after the packages have been moved off it, a limit switch (not shown) is closed to cause cylinder 125 to be energized, and ratchet cylinder 104 to be de-energized. Cylinder 125 moves chain 127, see FIG. 12, to rotate shaft 87 in the opposite direction to raise the elevator platform to its initial upper position.

The area immediately below stack section 15 and in which elevator 80 operates is defined by two side plates 158 and 159 spaced apart a distance substantially equal to the width of the package to be handled, see FIGS. 13 to 16. The plate 158 forms a pusher and is movable towards and away from conveyor section 22, while plate 159, which is located between the elevator section and the latter conveyor section, is movable vertically from and back to its normal position shown in FIG. 14.

Side plate or pusher 158 extends the full length of stack section 15, and means is provided at each end thereof for moving it laterally. In this example, a endless chain 165 is located at each end of plate 158, as shown in FIG. 14. Each chain 165 extends around spaced sprockets 166 and 167, and a bracket 169 connects plate 158 to the chain. A shaft 170 extends between the sprockets 166 at opposite ends of the stack section, said sprockets being fixedly mounted on this shaft. This shaft is rotated in any suitable manner, such as by means of a fluid cylinder 173 having a piston rod 174 extending therefrom and connected to an adjacent bracket 169.

Side plates 158 and 159 normally retain the packages on elevator 80. When it is desired to shift the stacks of packages off the elevator, plate 159 is depressed by suitable means, such as by a fluid cylinder 175 having a piston rod 176 connected to the lower edge of said plate, see FIG. 15.

When the required number of packages are stacked on elevator platform 82, plate 159 is depressed by cylinder 175, and then plate 158 is shifted laterally by cylinder 173 through shaft 170 and chains 165 connected to opposite ends of the plate.

Before the stacks of packages are shifted laterally off the elevator, it is desirable to press the stacks together longitudinally of the elevator in order to ensure that the packages of each stack are erect and in proper position. This is accomplished by means of an end plate 180, one at each end of side plate 158 and carried thereby, as clearly shown in FIG. 14.

Each plate 180 fits between the vertical side plates 158 and 159, and is mounted for limited movement longitudinally of plate 158. In this example, a pair of vertically spaced gussets 182 are secured to the outer surface of end plate 180 and extend through a slot 183 in plate 158 and are secured to a slide 185 slidably mounted in slots in upper and lower blocks 187 and 188, see FIGS. 13 to 16. Slide 185 is moved longitudinally of side plate 158 by a link 192 connected to the slide and extending along the outer surface of this plate to a cam disk 193 to which it is connected, said disk being rotatably mounted by a stub shaft 194 on the side plate. This cam disc is also connected by another link 192 to the side 185 of the end plate 180 at the opposite end of the elevator section Disc 193 is selectively rotated in opposite directions in any suitable manner, such as a fluid cylinder 195, to move the end plates 180 towards and away from each other.

End plates 180 at opposite ends of the elevator section are normally spread apart as far as they will go. After the required stacks are formed on the elevator, disk 193 is rotated to draw these plates 180 towards each other and this presses the stacks together on the elevator thereby straightening them up so that they are ready to be shifted laterally into conveyor section 22. The stacks are shifted off the elevator by pusher plate 158 under the action of cylinder 173. Side plate 159 has been depressed by cylinder 175 prior to this movement.

The apparatus has been described so far in connection with the formation of a single row of packages at a time in stack section 15. However, the apparatus can be quickly and easily adjusted to form two or three rows at a time, and it can be constructed to form even more rows, if they are required. FIGS. 17 and 19 illustrate the arrangement for two rows, while FIG. 18 illustrates the arrangement for three rows.

Referring to FIGS. 17 and 19, a divider 200 extends along the center of stack section 15 midway between side members 28 and terminates immediately above horizontal supports 36 of support members 32. The divider is secured at its upper edge near each end to a slide 202 which is slidably mounted in cross members 203 carried by vertical supports 204 which depend from beam 27. The slide 202 can be moved along members 203 to position the divider where required in the stack section, and is held in the selected position in any desired manner, such as by means of set screws 205 threaded in members 203 and bearing against the slide.

If three rows are to be formed in the stack section, divider 200 is shifted laterally and a second similar divider 206 is provided, said divider being slidably mounted on members 203 in the same manner as divider 200. Dividers 200 and 206 are shown in full lines in FIG. 18, and in broken lines in FIG. 19.

Figure 2:
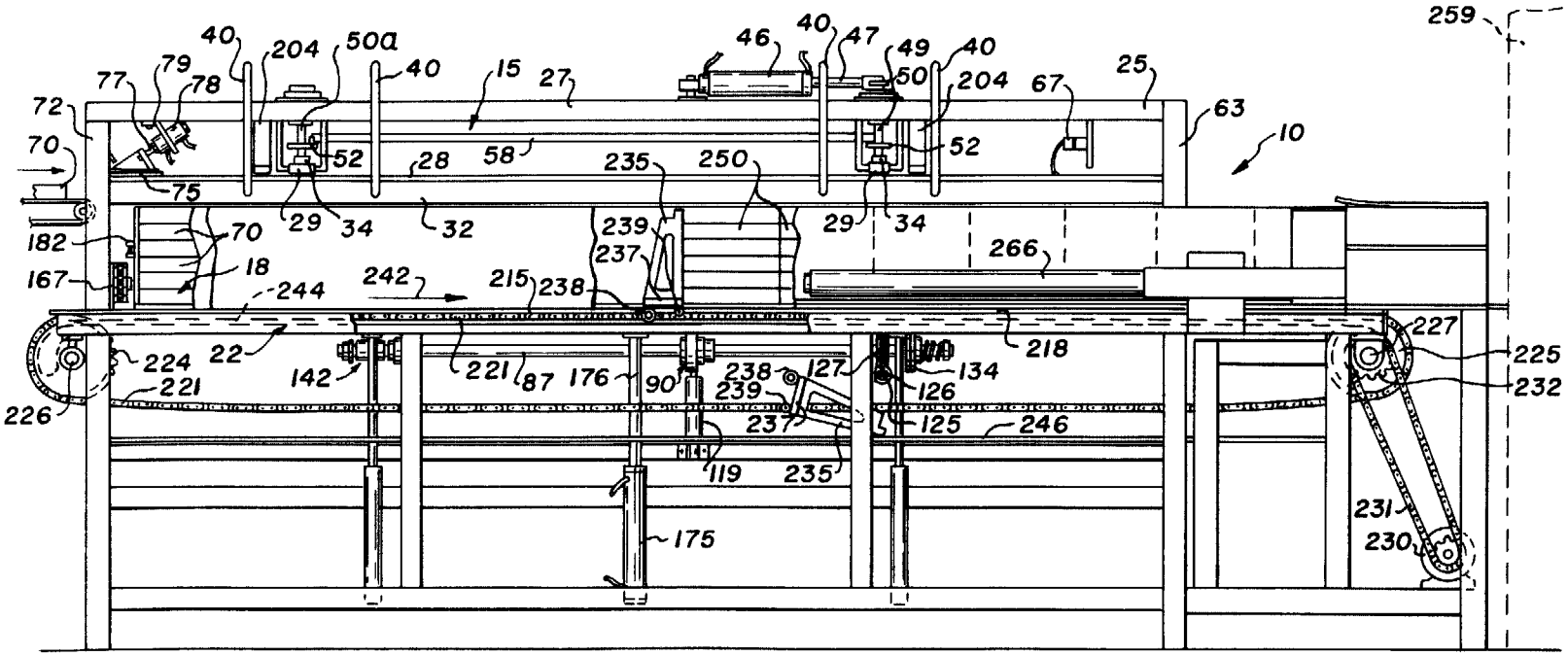
FIG. 2 is a side elevation.

An endless conveyor 215 is mounted in and extends longitudinally of conveyor 22 in parallel relationship to stack section 15, see FIGS. 1 and 2. This conveyor is immediately below a horizontal support 218 extending the length of the conveyor section and having a slot 219 substantially midway between its side edges. Conveyor 215 consists of two laterally spaced-apart chains 221 and 222 extending around pairs of sprockets 224 and 225 mounted on common shafts 226 and 227. Sprockets 224 are located at one end of conveyor section 22, while sprockets 225 are located at the opposite end of said section, said opposite end extending beyond the adjacent end of stack section 15, as clearly seen in FIGS. 1 and 2. The conveyor is driven by a motor 230 through a chain drive 231 which includes a sprocket 232 mounted on shaft 227.

A plurality of fingers 235, in this example two fingers, are connected to the chains of conveyor 215. Each finger 235 has a base 237 carrying a roller 238 at one end thereof, said base being connected by a pin 239 at its opposite end to the chains 221 and 222. When the conveyor is in operation, the upper runs of these chains travel through conveyor section 22 in the direction indicated by the arrow 242 in FIG. 2. At this time roller 238 of each finger as it travels through the conveyor section rides on a guide track 244 which is located immediately below slot 219 in support 218. At this time the finger stands upright, as clearly shown in FIG. 2. When the chains move around sprockets 225, the finger moving around the sprockets falls forward and hangs down from the chain from pin 239. If desired, a suitable web 246 may be positioned below the lower run of the conveyor chain to support the outer or free ends of the fingers as they move back beneath the conveyor section, as shown in FIG. 2.

When side plate 158 of the elevator section moves the stacked packages laterally off elevator 82, they are shifted on to support 218. Conveyor 215 is operated by controls, not shown, so as to move the stacks of packages in conveyor section 22 intermittently, the movement each time being equal to the length of a package. Stacks 250 of packages are shown in FIGS. 1 and 2.

Each time conveyor 215 is operated, a package stack 250 is shifted on to a platform 252 positioned at the level of support 218 just beyond the end thereof. A pusher plate 254 is positioned to one side of platform 252 and aligned with the stack on said platform. This plate is moved by fluid cylinder 255 to shift this package into position 257 on platform 252 aligned with the entrance 258 of a carton or wrapping machine 259, indicated in broken lines in FIG. 1. A flange 262 on the edge of pusher plate 254 retains the stacks 250 in the conveyor section while the pusher plate is moving a stack into the position 257. Another pusher plate 265 operated by a cylinder 266 is positioned in line with entrance 258 so that when the cylinder is operated, this pusher plate moves the stack 250 located at position 257 through entrance 258 into machine 259.

The operation of apparatus 10 is clear from the above description. The packages are fed through the end 72 of stack section 15 onto supports 36 in said section. The air emerging from the surfaces 37 forms a cushion to enable the packages to move easily and to keep said packages in proper position between side members 28 and prevent them from climbing on top of each other. Air from pipe 65 stops the movement of the row of packages in section 15, and operation of switch 67 by the first package to reach it causes pressure plate 75 to be moved down onto the last package in the section to retain the packages in position and to stop the flow of packages into the section. Cylinder 46 is energized to cause supports 36 to move away from each other so that the row of packages drops down onto platform 82 of the elevator or on to the uppermost row of packages on said elevator. Following this, the elevator is indexed downwardly a distance equal to the thickness of a package.

This action is repeated until the elevator platform reaches its lowermost point, at which time a predetermined number of packages are positioned in each of the stacks thereof on the elevator. Cylinder 195 is energized to move end plates 180 in the stack section towards each other to straighten up the stacks between side plates 158 and 159. Then plate 159 is moved downwardly to clear the stacks, following which cylinder 173 is energized to move side plate 158 laterally to shift the package stacks as a unit into conveyor section 22 and on to support 218 thereof. Side plate 159 is then moved back to its normal position, while cylinder 125 is energized to turn shaft 87 to move elevator platform 82 to its upper position. When pressure plate 75 is moved upwardly, the package thereunder is released so that a new row of packages can be fed into the stack section.

Conveyor 215 is operated intermittently to move the package stacks one by one on to platform 252, and the successive operation of cylinders 255 and 266 results in the stacks being shifted into carton or wrapping machine 259.

The various steps during the operation of apparatus 10 are initiated and controlled in accordance with standard practice in conveying and material handling machines, and do not require any special description herein.

I claim:

1. Apparatus for stacking packages comprising an elongated horizontal support, feeding means for feeding packages one by one on to one end of the support such that the force imparted to the packages on the feeding means is transferred to the packages on the support to cause each package on the support to move the package ahead thereof longitudinally of the support to form a plurality of successive rows of a predetermined number of packages, longitudinal guides along opposite sides of the support spaced laterally apart sufficiently to prevent the packages from rotating during movement over the support, first stop means at an opposite end of the support to engage the leading package of each row for stopping movement of each row onto or along the support when the predetermined number of packages are on the support, means to stop the packages from being fed to the support when said leading package is engaged by the first stop means, a depressible elevator positioned beneath the support and extending the length thereof, means for shifting the support after each row is formed thereon to deposit said row on to the elevator, means for depressing the elevator by substantially one package thickness after each row is deposited thereon, thereby forming stacks of predetermined numbers of packages on the elevator, a conveyor beside the elevator and extending longitudinally the length thereof, said conveyor being positioned at the level of the elevator when said elevator is in its lowermost depressed position, a first wall extending longitudinally on the side of the elevator remote from the conveyor above the elevator when the latter is in said lowermost position and a further wall extending longitudinally on the side of the elevator opposite from the first wall, said first and further walls positioned to confine the stacks of packages on the elevator therebetween as the stacks are being formed thereon, said first wall also being a portion of a pusher for pushing the stacks transversely across the elevator onto the conveyor, said pusher also including a power means connected to said first wall and operable to shift the first wall across the elevator and back again to shift the package stacks in a row laterally off the elevator and on to the conveyor and said further wall being shiftable to an inoperative position to permit the movement of the stacks by the pusher from the elevator to the conveyor.

2. Apparatus as claimed in claim 1 in which said first stop means comprises means for directing air longitudinally over the support in the direction opposite to the movement of the packages along said support to stop said movement.

3. Apparatus as claimed in claim 1 including means connected to said longitudinal guides to shift the guides towards and away from each other to accommodate packages of different widths on the support.

4. Apparatus as claimed in claim 1 including at least one vertical divider just above said support and extending longitudinally thereof to permit a plurality of rows of packages to be formed simultaneously on said support.

5. Apparatus as claimed in claim 4 including mounting means connected to each vertical divider and adjustable laterally relative to the support to accommodate packages of different widths in the rows being successively formed on the support.

6. Apparatus as claimed in claim 1 comprising a pair of end plates mounted one adjacent each end of the elevator for movement inwardly of and over the elevator when the latter is in the lowermost depressed position, and power means connected to the end plates operable to move the plates simultaneously inwardly over the elevator to press together the package stacks thereon.

7. Apparatus as claimed in claim 1 said further wall being a depressible vertical plate between the elevator and the conveyor and extending longitudinally substantially the length of the elevator, said vertical plate being substantially the height of the stacks on the elevator pusher wall, and power means connected to said vertical plate to depress it sufficiently to permit the pusher to shift the package stacks off the elevator on to the conveyor.

8. Apparatus as claimed in claim 7 comprising a pair of end plates mounted on the pusher one adjacent each end of the elevator and movable inwardly of and over the elevator when the latter is in its lowermost depressed position, and power means on the pusher and connected to the end plates operable to move the plates simultaneously inwardly over the elevator to press together the package stacks thereon.

9. Apparatus as claimed in claim 1 in which said support comprises a pair of support plates positioned near each other in a horizontal plane, and said means for shifting the support comprises means connected to said plates operable to shift the plates away from and towards each other.

10. Apparatus as claimed in claim 9 in which said plates have perforations therein, and including means for directing air upwardly through said perforations to provide an air cushion for packages being formed into rows on said plates.

11. Apparatus according to claim 1, said means to stop the packages from being fed to the support plates comprising a second stop means located adjacent said one end of the support.

12. Apparatus for stacking packages comprising a pair of elongated support plates positioned side by side in a horizontal plane, feeding means for feeding packages one by one directly on to one end of said support plates such that the force imparted to the packages on the feeding means is transferred to the packages on the support to cause each package on the support to move the package ahead thereof longitudinally of said plates to form a plurality of successive rows of a predetermined number of packages, said plates having perforations in upper surfaces thereof, means for directing air upwardly through said perforations to provide an air cushion for packages being formed in rows on said plates, longitudinal guides along opposite sides of the support plates spaced laterally apart sufficiently to prevent the packages from rotating during movement over said plates, first stop means at an opposite end of the support plates to engage the leading package of each row for stopping movement of each row onto or along the support when the predetermined number of packages are on the plates, means to stop the packages from being fed to the support plates when said leading package is engaged by the first stop means, depressible elevator positioned beneath the support plates and extending the length thereof, means connected to the support plates operable to shift the plates away from and towards each other after each row is formed thereon to deposit said row on to the elevator, means for depressing the elevator by substantially one package thickness after each row is deposited thereon, thereby forming stacks of predetermined numbers of packages on the elevator, a conveyor beside the elevator and extending longitudinally the length thereof, said conveyor being positioned at the level of the elevator when said elevator is in its lowermost depressed position, a first wall extending longitudinally on the side of the elevator remote from the conveyor above the elevator when the latter is in said lowermost position and a further wall extending longitudinally on the side of the elevator opposite from the first wall, said first and further walls positioned to confine the stacks of packages therebetween on the elevator as the stacks are being formed thereon, said first wall also being a portion of a pusher for pushing the stacks transversely across the elevator onto the conveyor, said pusher also including power means connected to said first wall and operable to shift the first wall across the elevator and back again to shift the package stacks in a row laterally off the elevator and on to the conveyor and said further wall being shiftable to an inoperative position to permit the movement of the stacks by the pusher from the elevator to the conveyor.

13. Apparatus as claimed in claim 12 in which said first stop means comprises means for directing air longitudinally over the support plates in the direction opposite to the movement of the packages along said plates to stop said movement.

14. Apparatus as claimed in claim 12 including means connected to said longitudinal guides to shift the guides towards and away from each other to accommodate packages of different widths on the support plates.

15. Apparatus as claimed in claim 12 including at least one vertical divider just above said support plates and extending longitudinally thereof to permit a plurality of rows of packages to be formed simultaneously on said plates.

16. Apparatus as claimed in claim 15 including mounting means connected to each vertical divider and adjustable laterally relative to the support plates to accommodate packages of different widths in the rows being successively formed on the plates.

17. Apparatus as claimed in claim 12 comprising a pair of end plates mounted one adjacent each end of the elevator for movement inwardly of and over the elevator when the latter is in its lowermost depressed position, and power means connected to the end plates operable to move the plates simultaneously inwardly over the elevator to press together the package stacks thereon.

18. Apparatus as claimed in claim 12, said further wall being a depressible vertical plate between the elevator and the conveyor and extending substantially the length of the elevator, said vertical plate being substantially the height of the stacks on the elevator and power means connected to said vertical plate to depress it sufficiently to permit the pusher to shift the package stacks off the elevator on to the conveyor.

19. Apparatus as claimed in claim 18 comprising a pair of end plates mounted on the pusher one adjacent each end of the elevator and movable inwardly of and over the elevator when the latter is in its lowermost depressed position, and power means on the pusher and connected to the end plates operable to move the plates simultaneously inwardly over the elevator to press together the package stacks thereon.

20. Apparatus as claimed in claim 12 in which said means for shifting the support plates comprises a plurality of longitudinally-spaced cross members mounted above and extending transversely relative to said support plates, a pair of blocks slidably mounted on each cross member one above each plate, connectors connecting each plate to the blocks thereabove, linkage means interconnecting said blocks and operable to shift the blocks connected to each of said plates, and power means connected to said linkage to operate the linkage to shift the blocks and the plates connected thereto towards and away from each other.

21. Apparatus for stacking packages comprising an elongated horizontal support, means for feeding packages one by one on to one end of the support to cause each package to move the package ahead thereof longitudinally of the support to form a plurality of successive rows of a predetermined number of packages, longitudinal guides along opposite sides of the support spaced laterally apart sufficiently to prevent the packages from rotating during movement over the support, first stop means at an opposite end of the support to engage the leading package of each row to stop said each row when the predetermined number of packages are on the support, said first stop means comprising means for directing air longitudinally over the support in the direction opposite to the movement of the packages along said support to stop said movement, second stop means adjacent said one end of the support operable to stop the packages from being fed to the support when said leading package is engaged by the first stop means, depressible elevator positioned beneath the support and extending the length thereof, means for shifting the support after each row is formed thereon to deposit said row on to the elevator, means for depressing the elevator by substantially one package thickness after each row is deposited thereon, thereby forming stacks of predetermined numbers of packages on the elevator, a conveyor beside the elevator and extending longitudinally the length thereof, said conveyor being positioned at the level of the elevator when said elevator is in its lowermost depressed position, a pusher positioned on the side of the elevator remote from the conveyor just above the elevator when the latter is in said lowermost position, and power means connected to said pusher operable to shift the pusher across the elevator and back again to shift the package stacks in a row laterally off the elevator and on to the conveyor.

22. Apparatus for stacking packages comprising a pair of elongated support plates positioned side by side in a horizontal plane, means for feeding packages one by one on to one end of said support plates to cause each package to move the package ahead thereof longitudinally of said plates to form a plurality of successive rows of a predetermined number of packages, said plates having perforations in upper surfaces thereof, means for directing air upwardly through said perforations to provide an air cushion for packages being formed in rows on said plates, longitudinal guides along opposite sides of the support plates spaced laterally apart sufficiently to prevent the packages from rotating during movement over said plates, first stop means at an opposite end of the support plates to engage the leading package of each row to stop said each row when the predetermined number of packages are on the plates, second stop means adjacent said one end of the plates operable to stop the packages from being fed to the support plates when said leading package is engaged by the first stop means, a depressible elevator positioned beneath the support plates and extending the length thereof, means connected to the support plates operable to shift the plates away from and towards each other after each row is formed thereon to deposit said row on to the elevator, means for depressing the elevator by substantially one package thickness after each row is deposited thereon, thereby forming stacks of predetermined numbers of packages on the elevator, a conveyor beside the elevator and extending longitudinally the length thereof, said conveyor being positioned at the level of the elevator when said elevator is in its lowermost depressed position, a pusher positioned on the side of the elevator remote from the conveyor just above the elevator when the latter is in said lowermost position, and power means connected to said pusher operable to shift the pusher wall across the elevator and back again to shift the package stacks in a row laterally off the elevator and on to the conveyor, said means for shifting the support plates comprising a plurality of longitudinally-spaced cross members mounted above and extending transversely relative to said support plates, a pair of blocks slidably mounted on each cross member one above each plate, connectors connecting each plate to the blocks thereabove, linkage means interconnecting said blocks and operable to shift the blocks connected to each of said plates, and power means connected to said linkage to operate the linkage to shift the blocks and the plates connected thereto towards and away from each other.

* * * * *